United States Patent [19]

Lavins, Jr.

[11] 4,075,450

[45] Feb. 21, 1978

[54] INDUCTION HEATER FOR FORGING BAR STOCK

[75] Inventor: Paul N. Lavins, Jr., Grosse Pointe Farms, Mich.

[73] Assignee: American Induction Heating Corporation, Detroit, Mich.

[21] Appl. No.: 660,067

[22] Filed: Feb. 23, 1976

[51] Int. Cl.[2] ..... H05B 5/02

[52] U.S. Cl. ..... 219/10.71; 219/10.43; 219/10.69

[58] Field of Search ..... 219/10.69, 10.73, 10.71, 219/10.67, 10.57, 10.79, 10.41, 10.43, 10.75; 266/129

[56] References Cited

U.S. PATENT DOCUMENTS

| | | | |
|---|---|---|---|
| 2,604,577 | 7/1952 | Strickland et al. | 219/10.69 |
| 2,666,830 | 1/1954 | Dreyfus | 219/10.69 X |
| 3,065,324 | 11/1962 | McNair et al. | 219/10.69 |
| 3,410,978 | 11/1968 | Sorensen | 219/10.69 |

FOREIGN PATENT DOCUMENTS

| | | | |
|---|---|---|---|
| 964,439 | 7/1964 | United Kingdom | 219/10.69 |

*Primary Examiner*—Bruce A. Reynolds
*Attorney, Agent, or Firm*—Krass & Young

[57] ABSTRACT

An induction heating system for reheating the end of a forging bar after a previously heated section has been forged and cut off includes a mechanism for bringing the entire bar end to a uniform temperature despite the existence of a hot spot at the end from the previous heat. A pusher rod which limits the extension of the bar into the axial passage of the heating coil is initially positioned beyond the end of the coil from which the rod is inserted so that the residual hot spot extends beyond the coil end. After a predetermined time sufficient to bring the bar section within the coil up to the temperature of the residual hot spot the rod moves the bar end back into the coil. After the bar end reaches forging temperature the pusher rod ejects the bar from the coil. A pair of fluid cylinders in back-to-back relationship control the motion of the rod.

8 Claims, 3 Drawing Figures

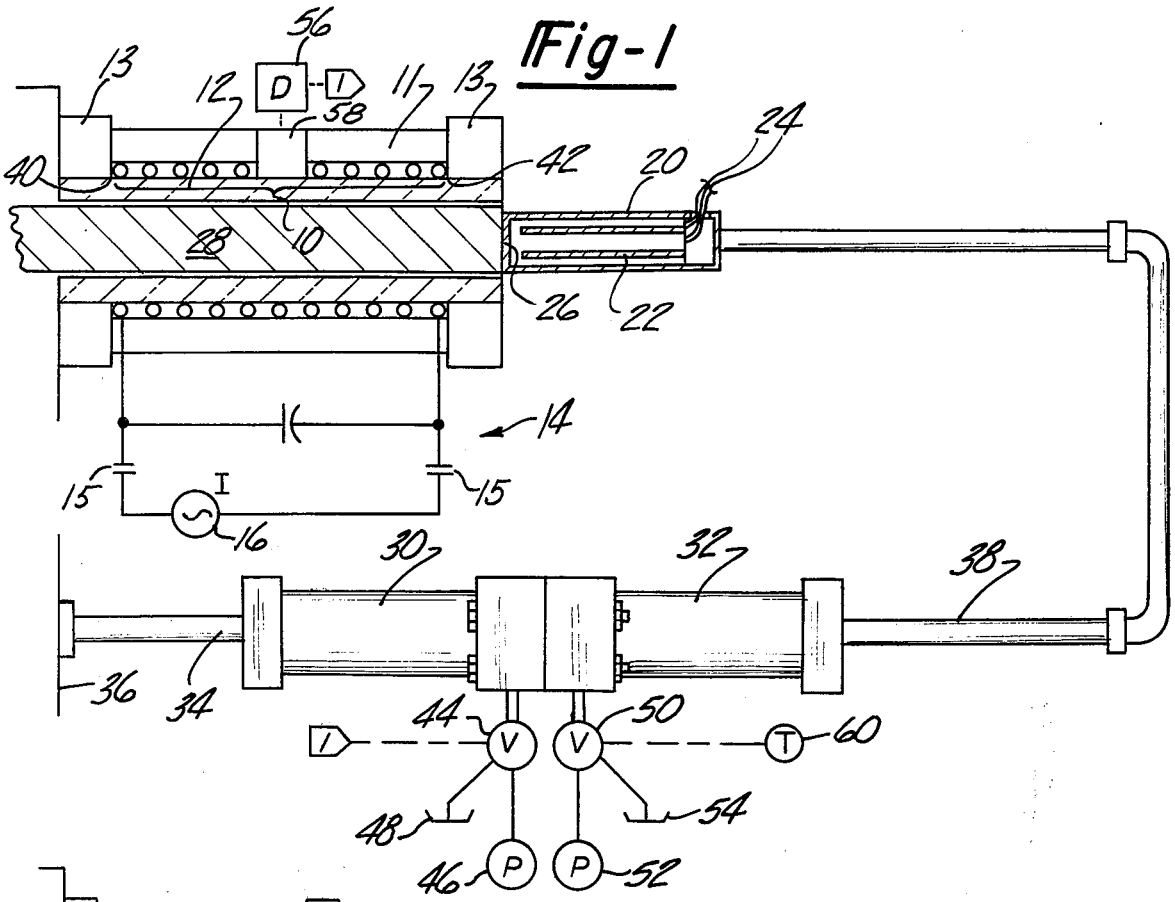
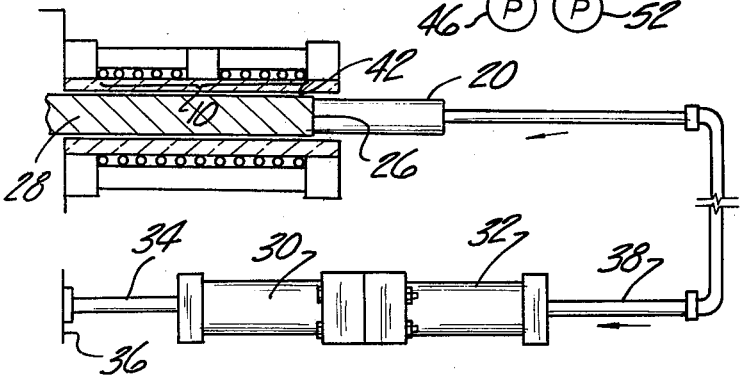
Fig-2
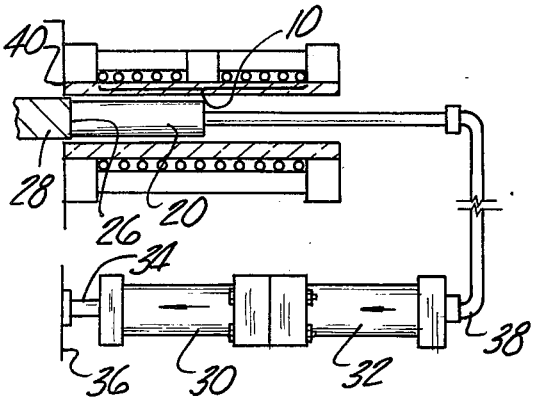
Fig-3

INDUCTION HEATER FOR FORGING BAR STOCK

BACKGROUND OF THE INVENTION

1. Field of the Invention

This invention relates to induction heating equipment for bars and more particularly to a work stop and push rod mechanism for use with an induction heating coil to raise the end of a long bar to uniform temperature despite the existence of a residual hot spot on the end of the bar before the heating operation.

2. Prior Art

In forging operations it is common practice to employ an elongated metal bar as forging stock. One end of the bar is heated and after the forging operations are completed the forging is cut off of the end of the bar and the bar is then reheated for a subsequent forging. This practice is termed "heating off the end of the bar". After a completed forging is cut off, a residual hot spot remains at the bar end.

This hot spot doesn't create any problem when the bar is heated in a combustion furnace since the furnace acts to bring the entire bar end up to the same final temperature despite the existence of the hot spot. However, it is not heretofore been practical to use induction heating systems to reheat forging bar ends since these induce energy into the workpiece as a function of the time that the workpiece is in the equipment and if a part orginally has two adjacent sections at substantially different temperatures, after induction heating this temperature differential will still exist. Accordingly, if a forging bar with a residual hot spot is placed into induction heating equipment and the cool end is brought up to forging temperature, the hot spot will be overheated and may even melt.

The present invention is broadly directed toward induction heating equipment designed to bring a forging bar having a residual hot spot on its extreme end up to a uniform forging temperature.

SUMMARY OF THE INVENTION

The present invention broadly takes the form of an induction heating system having a spirally wound coil surrounding an axial workpiece area. The coil is open at both ends so that an elongated workpiece may be inserted into the coil from one end so that its end projects beyond the coil at the opposite end. A push rod is supported for motion along the axis of the coil by a hydraulic or pneumatic powered actuator mechanism and acts to limit the position of the rod end with respect to the coil. When a rod having a residual hot spot on its end is to be heated the stop mechanism is initially positioned so that the hot spot extends beyond the prime heating area of the coil on the side opposite that from which the bar is inserted. Alternating current is then applied to the coil, inducing eddy currents into the section of the bar within the prime heating area to raise its temperature.

After a time predetermined to be sufficient to raise this heated length of the coil up to the same temperature as the residual bar end, the fluid powered actuator moves the stop toward the coil end so as to push the bar end into the prime heating area. The heating operation is then continued until an infra-red detector which senses the bar temperature controls the actuator to move the fully heated bar end out of the coil. This two-stage heating operation thus brings the entire bar end to a uniform temperature despite temperature variations that existed before the heating operation.

In a preferred embodiment of the invention, which will subsequently be described in detail, the fluid powered drive for the stop-pusher mechanism employs a pair of hydraulic or pneumatic cylinders fixed together with the rod of the first cylinder fixed relative to the equipment so that when fluid is admitted to the first cylinder both cylinders move with respect to the equipment. The rod of the second cylinder is connected to the stop mechanism. When both rods are extended the stop is positioned beyond the far end of the coil. Retraction of the rod of the first cylinder moves the push rod to the end of the coil heating area so that the entire rod end is in the heating area. Retraction of the rod of the second cylinder then pushes the rod through the coil to eject the heated bar.

In the preferred embodiment of the invention the push rod consists of a pair of concentric tubes connected so that cooling water passes between the tubes and then returns through the center of the interior tube.

Other objectives, advantages and applications of the present invention will be made apparent by the following detailed description of a preferred embodiment of the invention. The description makes reference to the accompanying drawings in which:

FIG. 1 is a sectional view through an induction heating system formed in accordance with the present invention heating a rod with a residual hot spot of the rod extending beyond the heating coil;

FIG. 2 is a cross sectional view through the induction furnace of FIG. 1 with the entire rod end extending within the heating coil; and FIG. 3 illustrates the pusher rod in the bar ejection position.

DETAILED DESCRIPTION OF A SPECIFIC EMBODIMENT

The induction heating system of the present invention, illustrated in the drawings, employs a spirally-wound induction heating coil 10 interposed between an outer cylindrical support 11 and an inner refractory work support tube 12. The outer cylindrical support 11 may be formed of a plurality of longitudinally extending support boards adapted to attach at their opposed ends to end boards 13. The inner refractory work support tube 12 is disposed coaxially within the coil 10 and is coterminous with the end boards 13. The coil 10 is adapted to be energized by a conventional tank circuit, shown generally at 14, which includes a suitable alternating current supply 16, controlled by switch means represented by contacts 15.

An elongated push rod 20 having a diameter smaller than the inner diameter of the inner support tube 12 is movable within the support tube, along its longitudinal axis. The push rod 20 has a cylindrical configuration and is formed with an inner tube 22 spaced from the outer rod surface 20 to form fluid passages between the outer surface of the tube 22 and the inner surface of the push rod 20, and centrally through the tube 22. These inner and outer passages are connected to a source of conventional cooling fluid through lines 24 so that fluid is forced through the outer passage and then returns through the center of the tube 22.

The push rod 20 has a forward surface 26 which acts as a stop for the end of a workpiece, exemplified by an elongated forging bar 28, which is to be heated prior to forging.

The push rod 20 is actuated by a system schematically illustrated as including a pair of hydraulic cylinders 30 and 32. The cylinders are connected together back-to-back so that their central axes are parallel to the central axis of the coil 10. The rod 34 of the cylinder 30 works against a stationary reference 36. The rod 38 of the cylinder 32 is connected to the rear end of the push rod 20. This arrangement of cylinders 30 and 32 provides two independently operable means of controlling the axial position of push rod 20. Specifically, if either or both of cylinders 30 and 32 extend their rods 34 and 38, respectively, the push rod 20 is moved from a first end of the coil 40 toward a second end of the coil 42; and as either or both of the cylinders 30 and 32 retract their rods 34 and 38, respectively, the push rod 20 is moved toward the first end 40. Moreover, rods 34 and 38 may be adjustable through a range of initial settings.

In the present embodiment, motion of the rod 34 of cylinder 30 is controlled by a four-way valve 44 connected to a pump 46 and a sump 48. Similarly, the motion of the rod 38 of the cylinder 32 is controlled by a four-way valve 50 connected to a pump 52 and a sump 54. For purposes which will hereinafter be made more apparent, the valve 50 is responsive to an electrical signal from a timer unit 60. Similarly, valve 44 is responsive to an electrical signal from an infra-red detector 56 which is supported within a window 58 between windings of the coil 10 to sense the temperature of the workpiece 28.

When the rods 34 and 38 of the cylinders 20 and 32, respectively, are both extended, the push rod 20 is positioned adjacent the second end 42 of the coil 10. In this position, an elongated workpiece 28 may be extended into the coil so that its terminal end extends beyond the terminal end of the coil 10, and is thus not within the prime heating range of the coil. This is the situation illustrated in FIG. 1. When the coil 10 is energized by the current source 16, the extreme end of the workpiece 28 will experience minimal temperature increase, but the portion of the workpiece 28 contained within the prime heating range of the coil 10 will experience substantial temperature increase.

If the workpiece 28 is a forging bar with a residual hot spot on its end, it is advantageous to avoid further heating of this hot spot until the adjacent portion of the workpiece is brought up to a comparable temperature. The time interval required to bring the portion adjacent the residual hot spot up to the desired temperature, may be predetermined on the basis of the material properties of each type of workpiece 28, or on the basis of tests, and set in the timer 60. At the end of that time interval, the timer 60 will send a signal to the valve 50 and thereby cause the cylinder 32 to retract its rod 38.

This moves the push rod 20 so that its stop end 26 is adjacent to or slightly within the second end of the coil 42. This is the situation illustrated in FIG. 2. With the push rod 20 in this position, the entire portion of the bar which is to be forged, including what was the residual hot spot, is disposed within the prime heating area of the coil 10.

The temperature of a portion of the workpiece 28 contained within the coil 10 is monitored by the infra-red detector 56. When it reaches the final temperature, a signal is sent to the valve 44 causing the cylinder 30 to retract its rod 34. The push rod 20 then moves the workpiece 28 completely out of the coil, in the manner illustrated in FIG. 3.

It is to be understood that while an exemplary form of the system has been illustrated, other physical arrangements within the scope and essence of the following claims could be used to practice the invention. For example, a pneumatic actuator system, as an alternative to the illustrated hydraulic actuator system, could be used to move the push rod. Additionally, the sequence is which cylinders 30 and 32 are actuated may be altered as a matter of design choice.

The embodiments of the invention in which an exclusive property or privilege is claimed are defined as follows:

1. An induction heating system for heating the end of a length of forging bar stock, comprising: an induction heating coil wound about a longitudinal axis; an elongated support for bar stock disposed on the longitudinal axis of the coil so that it extends beyond the coil at both ends; a push rod movable along the longitudinal axis of the coil and having a stop surface to abut one end of a bar retained on said support and inserted into the coil from a first end thereof, said push rod having a travel which extends the stop surface from said first end of the coil, through the coil, and substantially beyond the second end; actuator means for said push rod to move the stop between a first position wherein the stop is external of the coil and beyond the second end of the coil so that the end of a bar inserted into the coil with its end abutting the stop surface has its end extending beyond the coil, a second position wherein the stop surface is adjacent the second end of the heating coil so that a bar inserted into the coil from the first end with its end abutting the stop surface has its end supported within the coil, and a third position wherein the stop surface is adjacent the first end of the coil, whereby motion of the stop member between said second position and said third position pushes the end of the bar out of the coil; and control means for the actuator means operative to control the time that the stop occupies said first position.

2. The system of claim 1 wherein said means for moving the stop member between said first, second and third positions includes a pair of linear actuators having parallel motions, one actuator being connected to the rod and coupled in serial relation to the other actuator, whereby motion of the other actuator moves the one actuator.

3. The system of claim 1 wherein said control means includes an alternating current electric power supply; switch means for connecting the power supply to the coil; and means for causing the actuator means to move said rod from its first position to its second position a predetermined period of time after closure of said switch means.

4. The system of claim 1 including means for measuring the temperature of a bar stock section supported within the furnace; and means for causing the actuator to move the rod from its second position to its third position at such time as the means for measurement indicates that the stock has reached a predetermined temperature.

5. The induction system of claim 1 wherein the push rod includes passages for circulation of a cooling fluid.

6. An induction system for heating the end of a length of forging stock, comprising: an induction heating coil wound about a longitudinal axis; an alternating current electric power supply for the coil; switch means operative to connect the power supply to the coil; and elongated support for bar stock disposed on the longitudinal axis of the coil so that it extends beyond the coil at at least one end; a fluid cooled push rod movable along the longitudinal axis of the coil and having a stop surface adapted to abut one end of a bar retained on said support and inserted into the coil from a first end thereof, said rod having a travel which extends the stop surface from said first end of the coil, through the coil and substantially beyond the second end; a rod actuator comprising a pair of linear actuators having parallel motions, the first actuator being connected to the rod and being coupled in serial relation to the second actuator; means for energizing one of the actuators a predetermined time after the switch means supplies power to said coil to move the rod so that its stop surface moves from a position beyond said second end of the coil to a position adjacent the second end of the coil; and means for energizing the second actuator to move the rod so that its stop surface moves from adjacent the second end of the coil to adjacent the first end of the coil some period of time after said first actuator is energized.

7. The induction heating system of claim 6 wherein said means for energizing the second actuator to cause the rod to move its stop surface from adjacent the second end of the coil to adjacent the first end of the coil sometime after said first actuator is energized includes means for measuring the temperature of a bar supported in the coil.

8. The induction heating system of claim 6 wherein said linear actuators comprise fluid cylinders with reciprocable rods.

* * * * *